United States Patent [19]

Herbert

[11] 4,417,146

[45] Nov. 22, 1983

[54] X-RAY ATTENUATING APRON

[76] Inventor: Linton M. Herbert, 14255 Rosemary La. #8104, Largo, Fla. 33540

[21] Appl. No.: 282,135

[22] Filed: Jul. 10, 1981

[51] Int. Cl.[3] ..... G21F 3/02

[52] U.S. Cl. ..... 250/516.1; 2/51

[58] Field of Search ..... 250/516.1, 519.1; 2/2 R, 2.5, 48, 51, 52, 92, 49 R; 224/260-262, 153; 128/379; D2/226-229; D3/32

[56] References Cited

U.S. PATENT DOCUMENTS

| | | | |
|---|---|---|---|
| 1,348,204 | 8/1920 | Brewster | 2/2.5 |
| 1,839,262 | 1/1932 | Quinn | 2/48 |
| 3,581,961 | 6/1971 | Owens | 224/262 |
| 3,946,916 | 3/1976 | Lawrence | 224/262 |
| 3,996,620 | 12/1976 | Maine | 2/48 |
| 4,013,201 | 3/1977 | Potter | D3/32 |

FOREIGN PATENT DOCUMENTS

| | | | |
|---|---|---|---|
| 744092 | 2/1956 | United Kingdom | 2/51 |

*Primary Examiner*—Alfred E. Smith
*Assistant Examiner*—Carolyn E. Fields
*Attorney, Agent, or Firm*—Cahill, Sutton & Thomas

[57] ABSTRACT

An apron fabricated from a radiation attenuating material including a body section having first and second sides, a top and outer and inner surfaces. The apron also includes first and second shoulder straps which are connected to the top of the body section and horizontal stiffeners which extend through the straps and into the body section. The first and second sides of the apron body section include first and second vertically aligned rows of coupling elements which permit the first and second tie straps to be coupled to the apron body section at an adjustable vertical position. This vertical adjustment feature permits the tie straps to encircle the apron body section at a level adjacent to the upper hip area of the wearer to thereby secure the apron to the wearer's body. This coupling technique permits the weight of the apron to be supported by the wearer's hips rather than by the wearer's shoulders.

14 Claims, 4 Drawing Figures

X-RAY ATTENUATING APRON

BACKGROUND OF THE INVENTION

1. Field of the Invention

The present invention relates to radiation shielding garments for protecting an individual from X-ray radiation.

2. Description of the Prior Art

The prior art discloses various different configurations of X-ray attenuating aprons incorporating lead foil or other radiation opaque materials which inherently cause the garment to have a weight in the range of 15–20 pounds.

U.S. Pat. No. 2,404,255 (Green) discloses a protective apron having broadened shoulder straps to distribute the weight of the apron over the full width of the wearer's shoulders and a portion of the wearer's back. This apron also includes fixed position tie straps for securing the back wings.

U.S. Pat. No. 2,642,542 (Weinberg) discloses a radiation protective jacket which includes a semi-cylindrical body section having ends joined together by a zipper or vertically aligned snaps; or button. Two shoulder caps are coupled to the top of the body section to support and maintain the body section at a fixed position on the wearer.

U.S. Pat. No. 3,093,829 (Maine) discloses a protective apron having a high friction inner surface which causes the upper section of the apron to cling to the wearer's body across the shoulder region and permits the upper shoulder region of the apron to support the entire weight of the apron.

U.S. Pat. No. 2,494,664 (Lubow) discloses an X-ray protective apron having wide shoulder straps which surround the wearer's shoulders and distribute the weight of the apron over the shoulder area. This unique upper structure alleviates the need for retaining straps or tie straps.

U.S. Pat. No. 3,052,799 (Hollands) discloses a radiation protection garment which includes diagonal crossing flap members which overlap one another in the wearer's back region. This garment includes a fixed position tie string which is coupled to the diagonal crossing flap members.

U.S. Pat. No. 4,196,355 (Maine) discloses a two-piece radiation shield garment which includes vest and skirt sections.

SUMMARY OF THE INVENTION

It is therefore a primary object of the present invention to provide an X-ray attenuating apron which is coupled to the wearer's body in a manner which permits the wearer's hips to support virtually the entire weight of the garment to significantly enhance wearer comfort and to alleviate wearer fatigue.

Yet another object of the present invention is to provide an X-ray attenuating apron which includes first and second stiffeners which are coupled to the apron and which extend upward along the apron body and through the apron shoulder straps to support the shoulder straps above the shoulders of the wearer and to transfer the weight of the shoulder straps through the apron body section to the wearer's hips.

Still another object of the present invention is to provide an X-ray attenuating apron including first and second tie straps which can be coupled at an adjustable vertical position to the body section of the apron to permit the tie straps to encircle the apron body section at a level adjacent to the upper hip area of the wearer to thereby transfer the weight of the apron to the wearer's hips.

Briefly stated, and in accord with one embodiment of the invention, an X-ray attenuating apron includes an apron fabricated from a radiation attenuating material. The apron includes a body section having first and second sides, a top and outer and inner surfaces. First and second shoulder straps are coupled to the top of the apron body section. First and second tie straps are coupled at one end to the first and second sides of the apron body section at an adjustable vertical position to thereby secure the apron to the body of the wearer at a level adjacent to the upper hip area of the wearer to permit the weight of the apron to be supported by the wearer's hips.

DESCRIPTION OF THE DRAWING

The invention is pointed out with particularity in the appended claims. However, other objects and advantages together with the operation of the invention may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
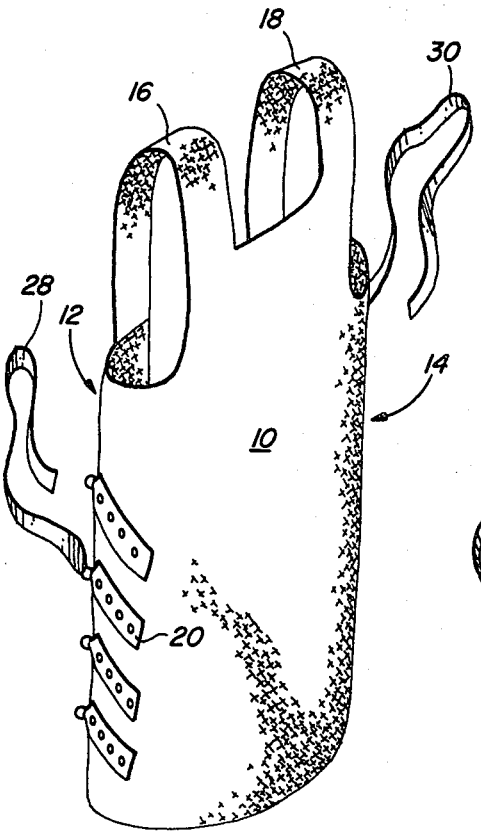
FIG. 1 is a perspective view of a preferred embodiment of an X-ray attenuating apron incorporating the present invention.
Figure 2:
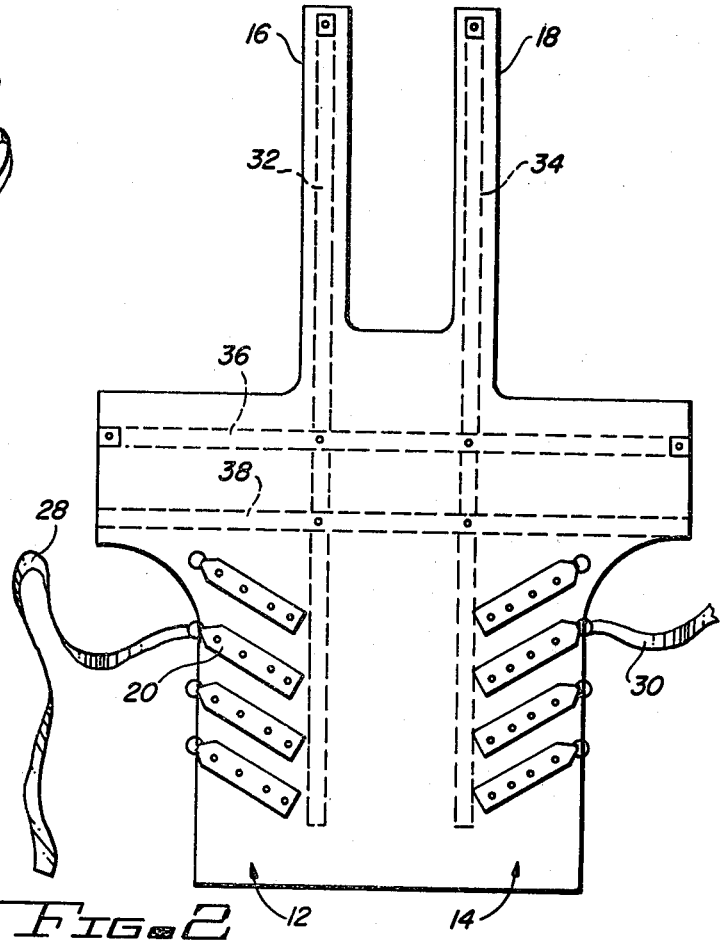
FIG. 2 is an elevational view of the X-ray attenuating apron depicted in FIG. 1, illustrating the apron in a flattened or spread out configuration.

Referring now to FIGS. 1 and 2, the X-ray attenuating apron of the present invention includes a body section 10 having a first side 12 and a second side 14. The apron also includes a first shoulder band 16 and second shoulder band 18.

Figure 3:
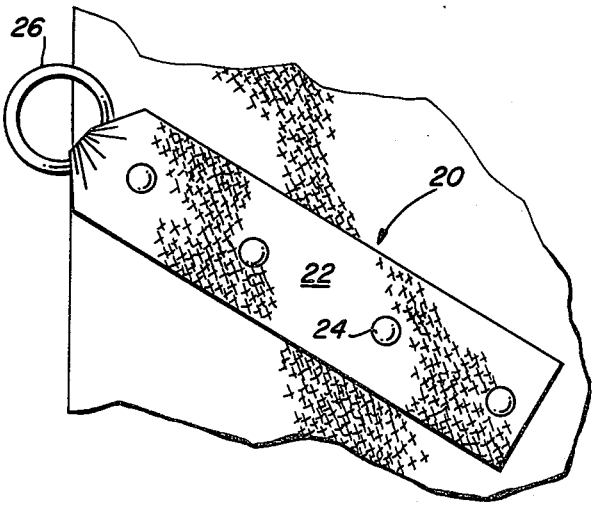
FIG. 3 is an enlarged elevational view of a single coupling element which permits one end of a tie strap to be coupled at an adjustable vertical position to the side surface of the apron body.

Apron body section 10 also includes coupling means which takes the form of first and second vertically aligned rows of coupling elements 20 which are secured along sides 12 and 14 of apron body section 10 within a weight transfer region. FIG. 3 is an enlarged view of a single coupling element 20.

Coupling element 20 includes a reinforcing strip 22 which is secured at an angle to the outer surface of apron body section 10 by a plurality of fastening means such as a rivet 24. The upper end of reinforcing strip 22 includes a coupling ring 26 or another equivalent form of securing means such as a clip, a snap, or a Velcro coupling system.

Tie straps 28 and 30 each include securing means positioned on one end which enables that end of the tie strap to be readily attached to and detached from coupling ring 26. In the preferred embodiment of the invention this securing means may take the form of a clip or a hook which readily permits tie straps 28 to be coupled to or detached from coupling rings 26 which forms a part of the two vertically aligned rows of coupling elements 20. Tie straps 28 and 30 may be fabricated in any desired configuration, but to maximize the support and weight transfer advantages of the present invention these tie straps should be fabricated with a width of approximately 2–3 inches as is commonly utilized in aircraft and automotive seat belts. The increased width of tie straps 28 and 30 maximizes the area over which the apron body section 10 is coupled above the wearer's hip region and not only increases the effective weight transfer but also increases wearer comfort.

Figure 4:
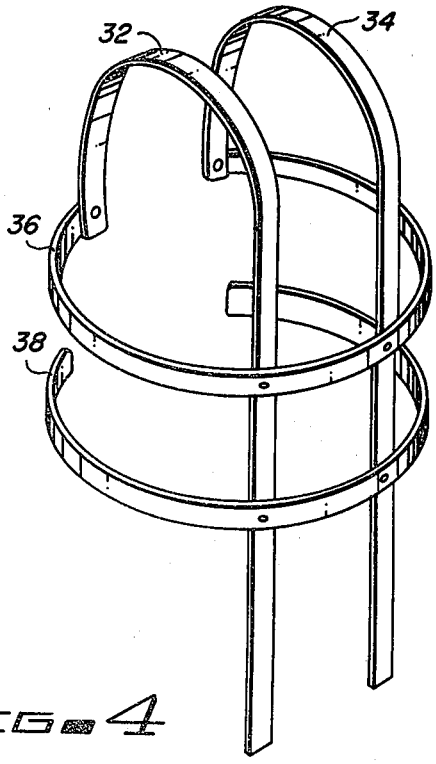
FIG. 4 is a perspective view of the two vertical stiffeners and the two horizontal stiffeners which are incorporated in the preferred embodiment of the present invention.

Referring now to FIGS. 2 and 4, the X-ray attenuating apron of the present embodiment also includes first and second vertical stiffeners 32 and 34. Stiffeners 32 and 34 may be fabricated from plastic, spring steel or an equivalent material and are configured in the inverted "J" form illustrated in FIG. 4. Stiffeners 32 and 34 should have a rigidity which permits them to fully support the weight of shoulder straps 16 and 18.

The X-ray attenuating apron of the present invention also include a first horizontal stiffener 36 and a second horizontal stiffener 38. Horizontal stiffeners 36 and 38 are fabricated from a plastic or spring steel material of a type which would be suitable for vertical stiffeners 32 and 34. Horizontal stiffeners 36 and 38 are also coupled to the inner surface of apron body section 10 and, in addition, are secured to vertical stiffeners 32 and 34 where the horizontal and vertical stiffeners cross. The rear end surfaces of horizontal stiffeners 36 may be coupled to the ends of vertical stiffeners 32 and 34 to provide a more rigid mechanical support system for the apron of the present invention. Horizontal stiffeners 36 and 38 are shaped into the semi-cylindrical configuration illustrated in FIG. 4 and serve the additional purpose of conforming apron body section 10 to the general shape of the trunk section of a human body. Horizontal stiffeners 36 and 38 thereby both maintain the apron body section 10 in close contact with the wearer's body and form a semi-rigid support structure for the apron of the present invention.

To use the X-ray attenuating apron of the present invention, a wearer dons the apron by spreading apart the outer ends of horizontal stiffeners 36 and 38 and inserting his arms through the shoulder apertures defined by shoulder strap 16 and 18. Tie straps 28 and 30 are then secured to a pair of coupling elements 20 at a vertical level which will cause tie straps 28 and 30 to encircle the wearer's body at a point just above the upper portion of the wearer's hips. The vertical positioning of the apron should also be adjusted at this time so that shoulder straps 16 and 18 are elevated slightly above the wearer's shoulders. This vertical adjustment ensures that the wearer's shoulders do not support a significant amount of the weight of either the shoulder straps or of the apron itself. Tie straps 28 and 30 are then passed behind the back of the wearer and are brought to a point in front of the wearer where they are secured by tying, by a Velcro securing arrangement or by any other equivalent mechanical system for maintaining the two straps in a fixed position on the front side of apron body section 10. If desired, a wearer may fully circle his body with tie straps 28 and 30 and secure them behind his back.

The advantages realized by the unique structure of the present invention are readily apparent. By properly adjusting and securing tie straps 28 and 30 at the proper vertical position, the tie straps encircle apron body section 10 to thereby secure the X-ray attenuating apron of the present invention to the body of the wearer at a vertical position just above the hip area which permits the weight of the apron to be supported by the wearer's hips. The fact that vertical stiffeners 32 and 34 are maintained slightly above the wearer's shoulders causes the weight of shoulder straps 16 and 18 to be transferred through vertical stiffeners 32 and 34 to the wearer's hips. The unique structure of the present invention transfers the weight of the apron body section and shoulder straps through the weight transfer region of the apron to the wearer's hips and substantially lessens shoulder and back fatigue problems commonly encountered when prior art X-ray attenuating garments are worn for more than a short period of time.

It will be apparent to those skilled in the art that the disclosed X-ray attenuating apron may be modified in numerous ways and may assume many embodiments other than the preferred form specifically set out and described above. Accordingly, it is intended by the appended claims to cover all such modifications of the invention which fall within the true spirit and scope of the invention.

I claim:

1. An X-ray attenuating apron comprising:

a. an apron fabricated from a radiation attenuating material including a body section having first and second sides, a top, outer and inner surfaces and a vertically distributed weight transfer region, the apron further including first and second shoulder straps coupled to the top of the apron body section;

b. means for transferring substantially the entire weight of the shoulder straps to the weight transfer region, said means for transferring comprising first and second spaced apart vertical stiffeners coupled to and extending upward from the weight transfer region along the apron body section and through the first and second shoulder straps;

c. first and second tie straps; and d. means for coupling one end of the first and second tie straps to the first and second sides of the apron body section at an adjustable vertical position within the weight transfer region to permit the tie straps to encircle the apron body section and secure the apron to the body of a wearer at a level within the weight transfer region and adjacent to the upper hip area of the wearer to thereby transfer the weight of the apron body section and shoulder straps to the wearer's hips.

2. The apron of claim 1 wherein the coupling means includes first and second vertically aligned rows of coupling elements secured along the first and second sides of the apron body section.

3. The apron of claim 2 wherein the coupling elements are vertically spaced apart and wherein the coupling elements are secured to the body of the apron by diagonally oriented reinforcing straps.

4. The apron of claim 3 wherein each of said coupling elements comprises a coupling ring.

5. The apron of claim 4 wherein each of said first and second tie straps include means for securing the end of each tie strap to a coupling ring.

6. The apron of claim 5 wherein the securing means includes a clip.

7. The apron of claim 6 further including means for imparting a curvature to the apron body section to cause the body section to conform to the wearer's body, said means for imparting comprising a first curved horizontal stiffener coupled to the apron body section at a level above the weight transfer region.

8. The apron of claim 7 wherein the horizontal stiffener is coupled to the inner surface of the apron body section.

9. The apron of claim 7 wherein said first horizontal stiffener is coupled to said first and second vertical stiffeners.

10. The apron of claim 9 further including a second curved horizontal stiffener coupled to the apron body section and spaced apart from said first horizontal stiffener.

11. The apron of claim 2 wherein the coupling elements are secured to the body of the apron by diagonally oriented reinforcing straps.

12. The apron of claim 11 wherein the reinforcing straps are secured to the apron by rivets.

13. The apron of claim 1 wherein the first and second vertical stiffeners are coupled to the inner surface of the apron body section.

14. The apron of claim 1 wherein the first and second tie straps each comprise a wide belt.

* * * * *